US005876006A

United States Patent [19]

Sharp et al.

[11] Patent Number: 5,876,006

[45] Date of Patent: Mar. 2, 1999

[54] STUD MOUNTING CLIP

[75] Inventors: Terry L. Sharp, Newman Lake; Richard C. Eldenburg, Spokane, both of Wash.

[73] Assignee: Scafco Corporation, Spokane, Wash.

[21] Appl. No.: 916,488

[22] Filed: Aug. 22, 1997

[51] Int. Cl.[6] ..... A47F 1/10

[52] U.S. Cl. ..... 248/297.21; 52/167.1; 403/28

[58] Field of Search ..... 248/297.21; 52/712, 52/714, 167.1, 167.3; 403/28, 403

[56] References Cited

U.S. PATENT DOCUMENTS

| | | | |
|---|---|---|---|
| 4,917,403 | 4/1990 | Gyoda et al. | 248/297.31 |
| 4,936,182 | 6/1990 | Bunker | 84/266 |
| 4,967,929 | 11/1990 | Turner | 248/214 |
| 5,664,392 | 9/1997 | Mucha | 52/712 |
| 5,720,465 | 2/1998 | Peltzer et al. | 248/453 |

*Primary Examiner*—Leslie A. Braun
*Assistant Examiner*—Robert Lipcsik
*Attorney, Agent, or Firm*—Wells, St. John, Roberts, Gregory & Matkin P.S.

[57] ABSTRACT

An improved stud mounting clip has a first bracket component and a second bracket component. The second bracket component is used to support outer wall components or panels and is fixed with respect to the position thereof. The second bracket component is allowed to move relative to a stud of the frame of the building by virtue of a first bracket component which securely engages the second bracket component such that the second bracket component may move with respect to the first bracket component. The first bracket component has an engaging component which engages the second bracket component, and a securing component which secures the second bracket component adjacent to a stud. In a preferred embodiment, the second bracket component is configured with an elongated slot in which a slightly shorter elongated engaging component on the first bracket component is received. The slot allows travel in the vertical direction thus allowing the frame and foundation of the building to settle as well as thermally differentially expand relative to the outer walls of the structure.

11 Claims, 4 Drawing Sheets

STUD MOUNTING CLIP

TECHNICAL FIELD

This invention pertains to articles used in construction of buildings, and in particular to stud mounting clips used to mount exterior walls to building structure.

BACKGROUND OF THE INVENTION

In construction of buildings, particularly light commercial buildings, the traditional fabrication process is to lay a foundation. A frame is then built upon the foundation and interior and exterior walls hung from the frame. Modern residential construction follows this similar format. Over time, it is not uncommon for the foundations of light commercial buildings and residential structures to settle due to continual compaction and subsidence of the ground on which the building has been constructed. Since the exterior walls are rigidly connected to the frame, as the foundation settles and moves in a downward direction, it pulls the exterior walls along with it. This can lead to a variety of problems. If the exterior walls overhang the foundation then if the walls contact the earth they may be pushed away from the frame by the weight of gravity pulling on the foundation and thus transferring the weight of the structure to the external walls. Also, if the external walls end up supporting the building then the foundation is not allowed to settle in its natural way which can lead to differential stresses on the foundation and eventually cracking.

If the exterior walls and frame of the structure are manufactured from materials having different coefficients of thermal expansion, as is often the case, changes in temperature may produce differential thermal expansion or contraction between the frame and the outer walls which can result in damage to the structure. For example, where a building having a metal frame with a relatively high coefficient of thermal expansion is provided with exterior walls having a relatively low coefficient of thermal expansion, in the winter months when the interior of the building is heated to approximately 75 degrees and the external temperature drops to subzero temperatures, a situation of high thermal stress between the building frame and the exterior walls occurs. In this case, the result might be that the panels of the exterior walls are pulled apart and gaps form in the exterior panels of the building due to the relative expansion of the frame with respect to the relative contraction of the outer panels. This will produce gaps in the panels allowing the cold air and moisture to intrude into the space between the internal and external walls, with concomitant problems associated therewith.

Traditional methods for attaching exterior walls of structures to the frame do not allow relative movement between the frame and the outer walls, and therefore the problems discussed above continue to occur. Therefore, what is needed in the industry is a method for allowing the frame of a building to move freely with respect to the outer walls of the building yet still provide support for the outer walls. Due to the low profit margins in the building industry, the solution to the problem must be economical and not provide great additional cost for building the structure.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

While the invention is described primarily with respect to mounting exterior walls to a building or structure, it will also be appreciated that the method and apparatus described and claimed herein may be equally well applied to mounting interior walls to a building.

The apparatus of the present invention is a bracket comprising two components. The first bracket component is configured to be attached rigidly to a mounting stud. The second component is configured to be engaged by the first bracket component and move with respect thereto. The second bracket component is configured to be attached to the inner surface of a wall of a building, either an inner wall or an outer wall. The second bracket component is thereby configured to allow movement of the attached wall of the building and thus the second bracket component with respect to a stud in the building and therefore the engaging first bracket component.

Figure 1:
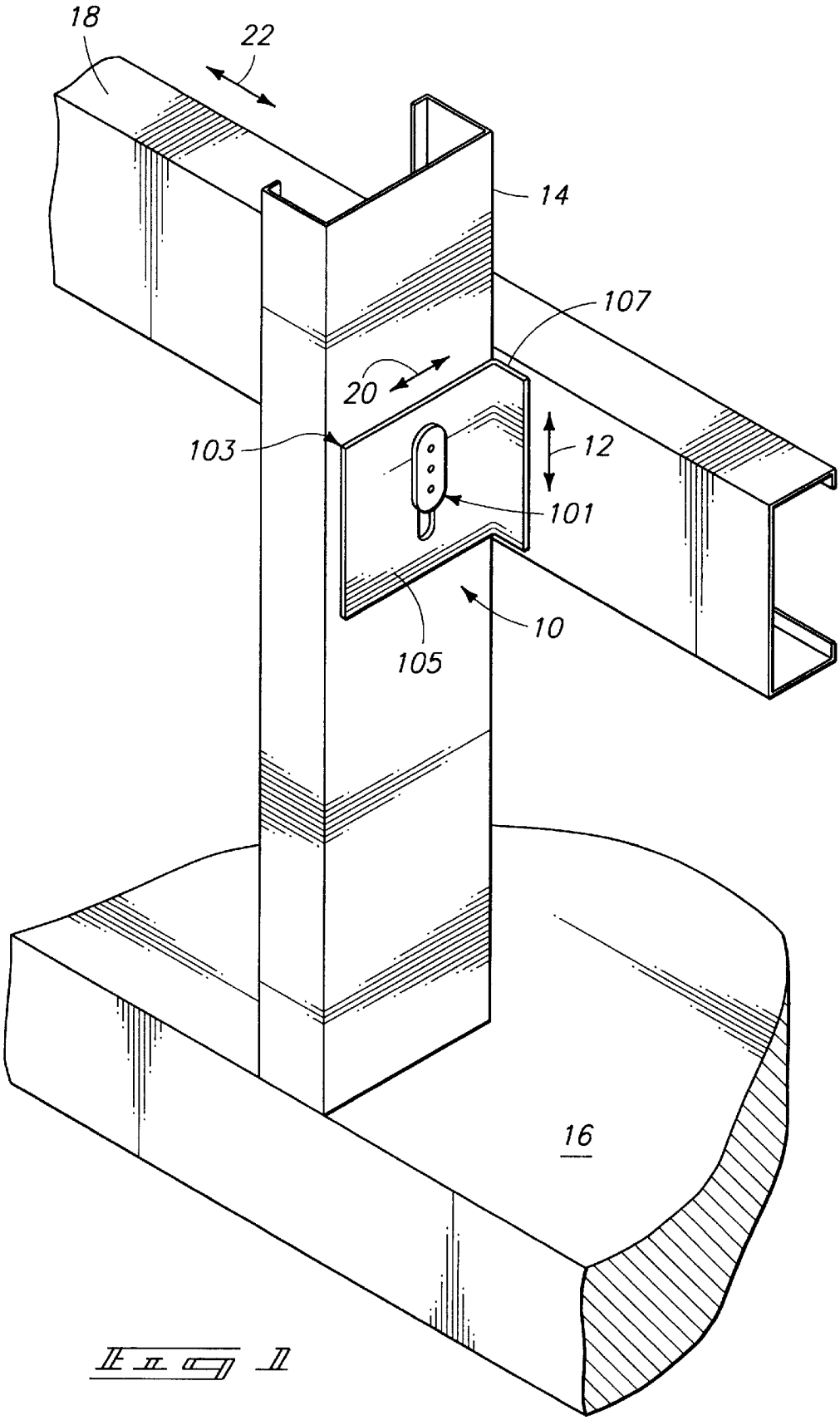
FIG. 1 is an environmental view showing the apparatus of the present invention as installed in a building structure.

With respect to FIG. 1, the mounting clip 10 of the present invention is shown in an environmental picture. Mounting clip 10 comprises a first bracket component 101 and a second bracket component 103. First bracket component 101 is configured to be rigidly attached to a stud 14. Stud 14 is but one stud in the frame of a building, the studs being attached to the foundation 16 by any normal construction means. First bracket component 101 secures second bracket component 103 against stud 14 in a manner further described below in order to allow second bracket component 103 to move freely in the direction of the arrows 12. Second bracket component 103 has a stud mating surface 105 which, when the mounting clip 10 is installed, is positioned adjacent to stud 14. Second bracket component 103 further comprises a wall mounting surface 107 which is used to attach the second bracket component 103 to a wall member such as wall member 18.

It can therefore be seen that in its broadest embodiment the mounting clip of the present invention comprises a two component clip, a first bracket component configured to be rigidly attached to a stud, and a second bracket component configured to mount slidably with respect to the stud and configured to be attached to a wall component, the second bracket component moveable with respect to the stud via engagement with the first bracket component.

While but one particular example of the present invention is described in detail below, it will be appreciated that movement of the second bracket component 103 with respect to stud 14 is not constrained to movement in the vertical as shown by arrows 12 of FIG. 1. In certain applications, horizontal movement may also be allowed, or horizontal movement alone desired. Typically, the horizontal movement allowed will be in the direction of arrows 20 of FIG. 1. Normally, the bracket will be configured so as to constrain movement of the second bracket component with respect to the stud such that movement in direction of the arrows 22 will not occur. However, in certain applications a small amount of movement in the directions of arrows 22 may be desired. Movement in direction of arrows 22 can be provided for as further described below.

Figure 2:
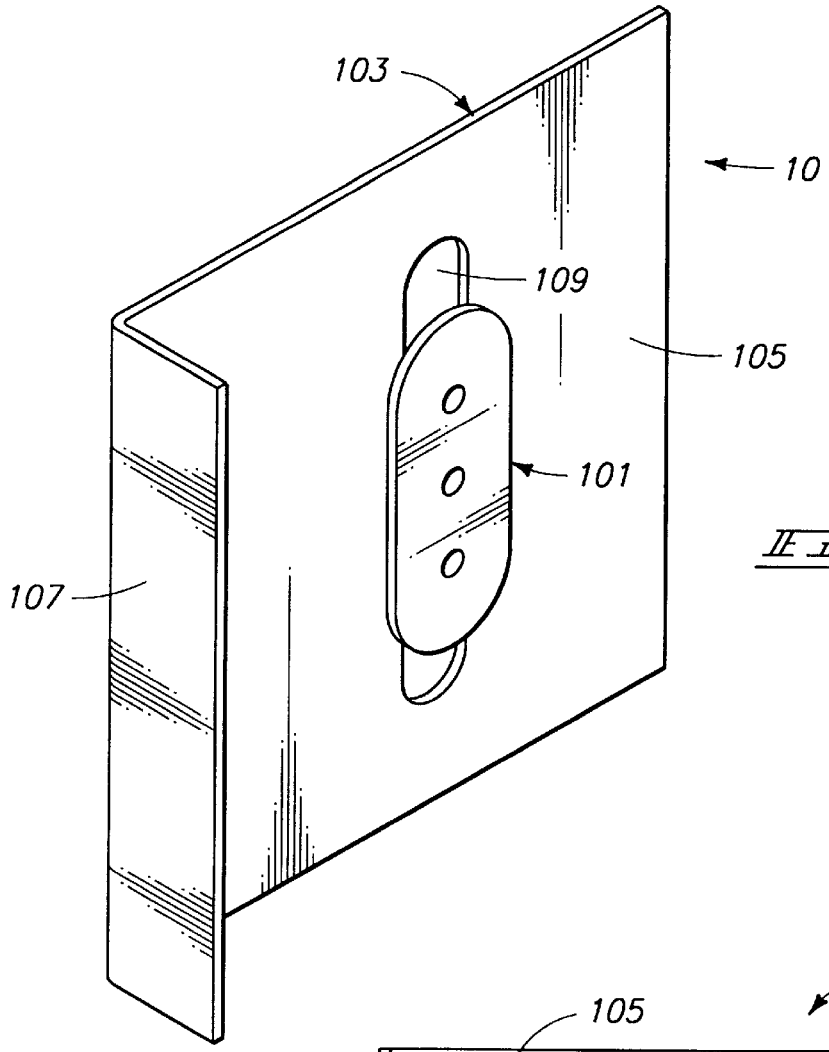
FIG. 2 is an isometric view of the improved stud mounting clip of the present invention.
Figure 3:
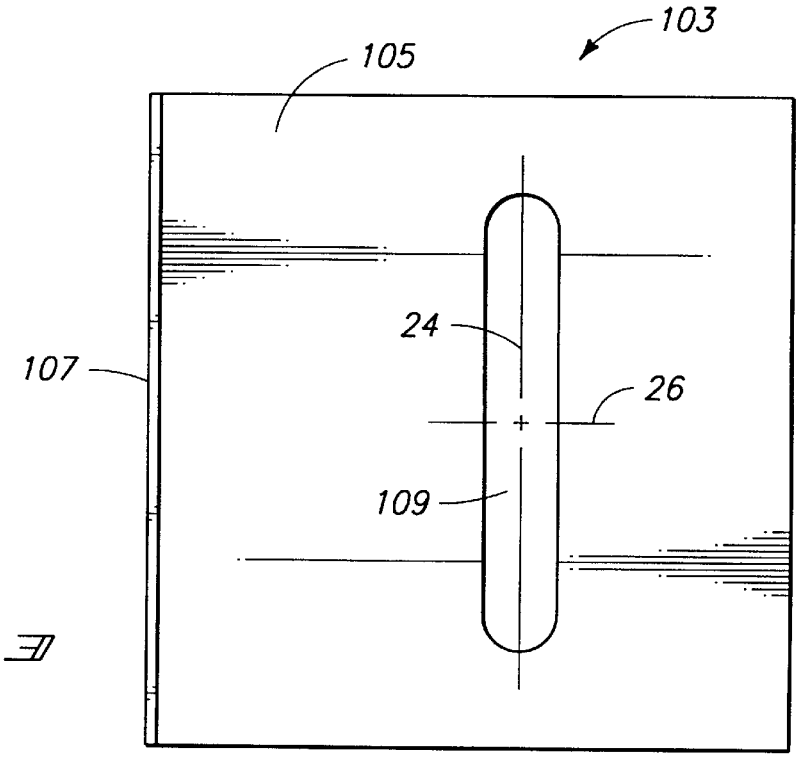
FIG. 3 is a side view of the second bracket component.

Turning to FIG. 2, the apparatus 10 of the present invention is shown. The stud mounting clip 10 comprises a first bracket component 101 and a second bracket component 103. Turning to FIG. 3, second bracket component 103 is configured with an essentially flat first side 105 which corresponds to a stud mounting surface. Stud mounting surface 105 is intended to mount flush to the stud of a building. Second bracket component 103 further comprises an essentially flat second side 107 with corresponds to a building panel mounting surface. Building panel mounting surface 107 is intended to join the second bracket component 103 to the interior surface of a wall, building panel, or other component from which the interior or exterior walls or panels of a building are mounted or suspended. Second bracket component 103 is attached to wall members and building panels in any traditional method known, and therefore will not be described further herein with respect to that detail.

Second bracket component 103 further comprises an opening 109 disposed in stud mounting surface 105. Opening 109 is preferably closed at at least one end, preferably the upper end, to allow this moveable bracket component to rest against installed first bracket component 101 when in use. This allows second bracket component 103 to bear weight by virtue of first bracket component 101.

Although opening 109 is shown in FIG. 3 as an elongated slot having a major axis 24 and a minor axis 26, other opening shapes may further be employed, as further described below.

The second bracket component 103 is preferably an L-shaped bracket and may be fabricated by, for example, bending a sheet of metal on a break press.

Figure 4:
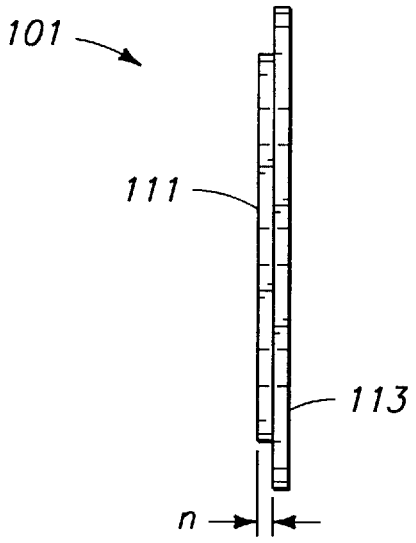
FIG. 4 is a side view of the first bracket component.
Figure 5:
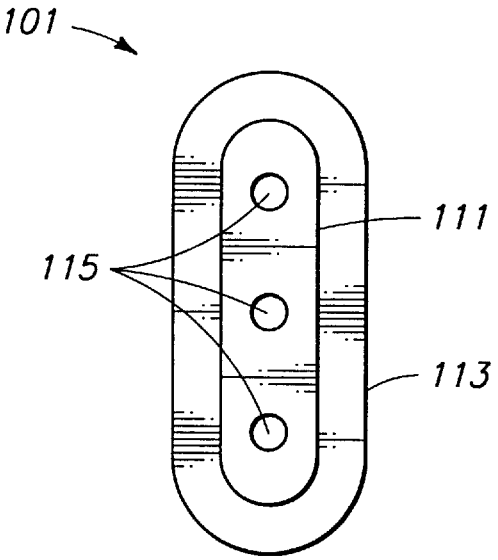
FIG. 5 is a rear view of the first bracket component.

Turning now to FIG. 5, a rear view of first bracket component 101 is shown. First bracket component 101 comprises an engaging component 111 and a securing component 113. Engaging component 111 is configured to be receivable within opening 109 of second bracket component 103. FIG. 4 provides a side view of first bracket component 101 showing engaging component 111 as essentially a stepped surface rising from securing component 113. In FIG. 5, first bracket component 101 is shown with optionally provided mounting holes 115. Mounting holes 115 may be used to securely mount first bracket component 101 to stud 14 by such fastening means as rivets or screws. However, first bracket component may be rigidly attached to stud 14 by other means known in the art such as spot welding, or, in the case where the stud is wood, by nails or other known fastening means.

Engaging component 111 of FIG. 4 is configured to be received within opening 109 of second bracket component 103. In the embodiment where directional motion of second bracket component 103 with respect to stud 14 is to be constrained in the direction of arrows 12 of FIG. 1, the width of engaging component 111 is marginally narrower than the dimension of the minor axis 26 of opening 109 as shown in FIG. 3. The height of engaging component 111 will be equal to the dimension of the major axis 24 of opening 109 of FIG. 3 minus the length over which movement in direction of arrows 22 is to be allowed. For example, if the length of the major axis 24 of the opening 109 is 15 cm and motion in the vertical direction of up to 5 cm is to be allowed, then the height of the engaging component 111 will be 15 cm minus 5 cm equals 10 cm.

It will be appreciated that opening 109 and engaging component 111 may take on other shapes. For example, opening 109 may be a circular opening and engaging component 111 may be circular in shape having a smaller diameter than the opening. In this case, motion will be allowed in the direction of arrows 12 and 20 of FIG. 1, however the range of movement will be constrained by the shape of the opening.

The thickness "n" of engaging component 111 as shown in FIG. 4 is preferably the same or slightly greater than the thickness of the first side 105 of second bracket component 103. This allows first bracket component 101 to be rigidly attached to the stud without binding the securing surface 113 tightly against the stud mating surface 105, which would prevent movement of the second bracket component 103.

First bracket component 101 further comprises securing component 113. Securing component 113 is dimensionally configured such that when engaging component 111 is positioned within opening 109 the first bracket component 101 may not pass through opening 109. That is, securing surface 113 forms a washer or bearing surface to secure second bracket component 103 against stud 14 when the clip assembly is installed.

First bracket component 101 may be configured by fabricating engaging element 111 and securing element 113 out of a sheet of material and then joining them together by such means as welding, screwing, gluing, or other means sufficient to withstand the anticipated tensile strength which may be imposed on the engaging element to securing element joint. First bracket component 101 may also be fabricated out of a single piece of material, as for example a single piece of metal by milling a step around the periphery of the component, thus producing a raised area which becomes the engaging component 111, leaving the remainder of the component to form the securing element 113.

Figure 6:
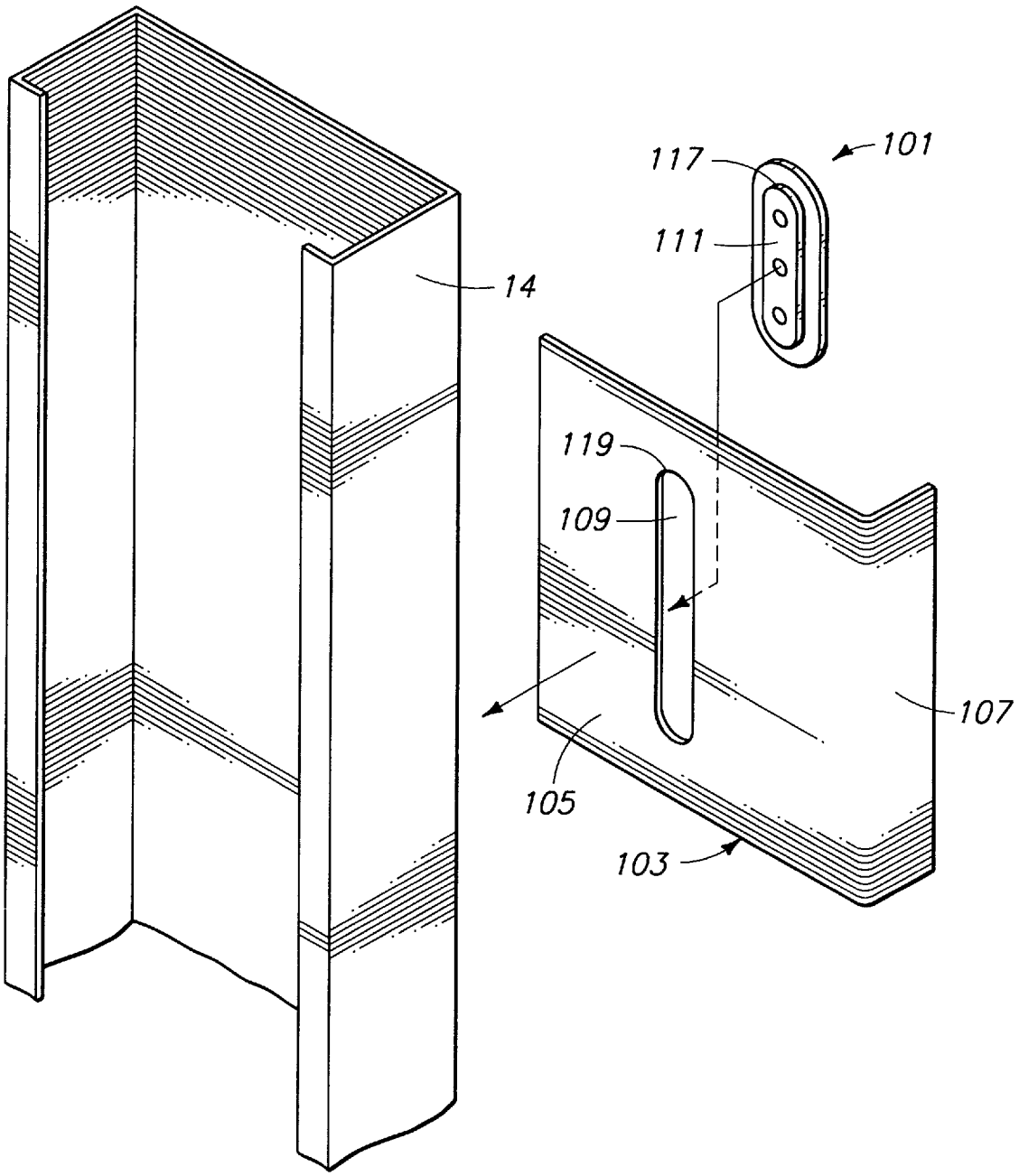
FIG. 6 is an exploded isometric showing how the improved stud mounting clip of the present invention is mounted to a stud.

FIG. 6 shows the assembly of the stud mounting clip. In installation of the apparatus, second bracket component 103 is positioned against stud 14 in the desired position. First bracket component 101 is positioned such that engaging surface 111 is positioned within slot 109. Bracket component 101 is preferably positioned with respect to second bracket component 103 such that the upper surface 117 of is engaging component 111 is in contact with the upper edge 119 of opening 109. This allows second bracket component 103 to become a weight bearing support, thus transferring its load to stud 14 via first bracket component 101 and in particular engaging component 111. Once first bracket component 101 is rigidly attached to stud 14 in any known manner, building panels or wall components 18 (FIG. 1) are then attached to second bracket component 103 using wall mounting surface 107 by any known means in the art.

When installed, second bracket component 103 should be free to move in the directions intended. Freedom of movement will primarily be governed by the dimensions of engaging component 111 with respect to opening 109, as well as by the thickness of engaging component 111 with respect to the thickness of second bracket component first side 105, as discussed above.

In many applications it will be desirable to minimize the cost of fabrication and installation of the improved stud mounting clip of the present invention. Therefore, a simple fabrication process may be used such as forming the second bracket component out of a rectangular piece of flat steel and then bending the piece of steel on a break press to form first side 105 and second side 107. Opening 109 may then be stamped into the bracket. Alternately, the opening may be first stamped. Likewise, first bracket component 101 may be fabricated by stamping engaging component 111 out of a sheet of steel. Engaging component 111 may then be fastened to securing component 113 by fastening means such as spot welding and the like. Preferably, the engaging component 111 has a geometry similar to that of the opening 109. That is, where opening 109 is shown as having a rounded upper surface 119 in FIG. 6, likewise engaging component upper surface 117 is also rounded. This helps to prevent engaging component 111 from binding against second bracket component first side 105. For example, if engaging component upper surface 117 were configured in a square, the corners of the square may dig into the upper surface 119 of opening 109 such that the engaging element 111 will not freely disengage from the opening when second bracket component 103 tries to move relative to first bracket component 101. Securing component 113 may also be fabricated by stamping or cutting a piece of metal to the desired shape. While shown in the present invention as an elongated member having rounded ends, there is no need for securing component 113 to have any particular geometry other than the securing geometry described above to prevent second component 103 from moving away from stud 14 in the direction of arrows 22 of FIG. 1.

While in the preferred embodiment it is desirable to keep the cost of manufacturing the stud mounting clip of the present invention low, certain applications may justify the cost of additional components. For example, to reduce the friction between the stud mounting surface 105 and stud 14, a lubricating pad containing graphite or silicone or the like may be provided. Further, to allow motion of the second bracket component 103 in the direction of arrows 22 of FIG. 1, a flexible washer, gasket or bushing or the like may be disposed between securing component 113 of first bracket component 101 and the outer surface of first side 105 of second bracket component 103.

In its broadest embodiment then the invention comprises a first bracket component 101 which is attachable to a stud 14 and a second bracket component 103 which is attachable to a wall or panel member 18. The first bracket component securely engages the second bracket component such that the second bracket component may move freely in a desired direction with respect to the first bracket component.

Preferably, the second bracket component is constrained to movement in the plane of the surface of the stud to which the second bracket component is positioned. More preferably, the second bracket component is constrained to movement in the vertical direction.

Various configurations other than the opening and engaging element combination described herein may be employed to allow the second bracket component to move relative to the first bracket component.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A two-component mounting clip for installation during building construction to permit subsequent free relative movement between first and second structural members, the mounting clip comprising:

a first elongated bracket component rigidly attachable to a surface of one of the structural members; and a second L-shaped bracket component having first and second legs, the first leg being adapted to rest against the surface of the one structural member to which the elongated bracket component is attached and the second leg being attachable to a surface of the remaining structural member;

the first leg of the L-shaped bracket component being defined by a first thickness surrounding opposed sides of an elongated slot formed through it for free movable engagement of the slot about the first elongated bracket component such that the L-shaped bracket component may move in a constrained, non-rotational linear direction with respect to the elongated bracket component;

said elongated bracket component further comprising an engaging component and a securing component fixed relative to one another;

the engaging component having a surface adapted to mount flush with the surface of the one structural member when disposed within the slot and having a second thickness of the first leg of the L-shaped bracket component slightly greater than said first thickness such that said engaging component is free to move within the slot and allows the first leg of the L-shaped bracket component to be guided by the engaging component, the engaging component also having elongated sides slidably engaging the sides of the slot for restricting movement of the L-shaped bracket component to its linear direction with respect to the elongated bracket component;

the securing component including a bearing surface configured to prevent the movable first leg of the L-shaped bracket component from disengaging from the elongated bracket component when the two-component mounting clip is installed in a building structure, the bearing surface overlapping at least part of the elongated slot of the first leg of the L-shaped bracket component to constrain the L-shaped bracket component to movement in the plane of the surface engaged by the first leg of the L-shaped bracket component.

2. The two-component mounting clip of claim 1 wherein the non-rotational, linear direction in which the L-shaped bracket component is free to move with respect to the elongated bracket component is the vertical direction.

3. The two component mounting clip of claim 1 wherein the elongated slot has a major and a minor axis of symmetry, and wherein said engaging component is configured to fit within said slot such that said engaging component may slide freely within said slot along said major axis of symmetry.

4. The two component mounting clip of claim 1 wherein said engaging component is a first flat plate.

5. The two component mounting clip of claim 1 wherein when said securing component has at least one dimension larger than a corresponding dimension of said slot thereby preventing said engaging component from passing through said slot when engaged with the first leg of the L-shaped bracket component.

6. The two component mounting clip of claim 5 wherein the elongated bracket component is provided with at least one mounting hole to allow the elongated bracket component to be mounted to the one structural member by use of a fastener engaging the one structural member through said mounting hole.

7. The two component mounting clip of claim 1 wherein the L-shaped bracket component comprises a flat first side for positioning adjacent to the one structural member and a flat second side perpendicular to said first side for positioning adjacent to the remaining structural member.

8. The two component mounting clip of claim 1 wherein:

the elongated slot has a major axis and a minor axis, said axes oriented such that when the L-shaped bracket component is installed said major axis is in a vertical position; and said engaging component comprises a first flat plate configured to fit within said slot and constrain movement of said engaging component with respect to the L-shaped bracket component to a direction parallel to said major axis.

9. The two component mounting clip of claim 8 wherein said securing component comprises an essentially flat second plate positioned parallel to said engaging component, said second plate having a width dimension which corresponds directionally to said minor axis of said opening when said engaging component is disposed therein, said width dimension being greater than said minor axis.

10. The two component mounting clip of claim 1 wherein the elongated bracket component comprises a first metal plate spot welded to a second metal plate, said first metal plate configured to be receivable within the slot in the L-shaped bracket component, said second metal plate configured to allow said engaging component to be received within said slot but prevent said engaging component from passing therethrough.

11. The two component mounting clip of claim 1 wherein the elongated bracket component is fabricated from a piece of metal having a recess formed about its periphery to produce a raised portion dimensionally configured to be receivable within the slot of the L-shaped bracket component, said raised portion corresponding to said engaging component.

* * * * *

UNITED STATES PATENT AND TRADEMARK OFFICE

CERTIFICATE OF CORRECTION

PATENT NO. : 5,876,006
DATED : March 2, 1999
INVENTOR(S) : Terry L. Sharp, et al.

It is certified that error appears in the above-identified patent and that said Letters Patent is hereby corrected as shown below:

In column 4, line 47, after the phrase "surface 117 of", delete the word "is".

Signed and Sealed this

Third Day of August, 1999

*Attest:*

Q. TODD DICKINSON

*Attesting Officer*

*Acting Commissioner of Patents and Trademarks*